United States Patent [19]

Grebe et al.

[11] Patent Number: 4,520,963

[45] Date of Patent: Jun. 4, 1985

[54] PROCESS AND EQUIPMENT FOR CONTINUOUS CUTTING OF MATERIAL

[75] Inventors: Reiner Grebe, Biedenkopf; Max Norbisrath; Karl-Heinz Schmidt, both of Breidenbach, all of Fed. Rep. of Germany

[73] Assignee: Kramer & Grebe GmbH & Co. KG, Biedenkopf-Wallau, Fed. Rep. of Germany

[21] Appl. No.: 378,520

[22] Filed: May 17, 1982

[30] Foreign Application Priority Data

Jun. 4, 1981 [DE] Fed. Rep. of Germany ..... 3122266

[51] Int. Cl.[3] ..... B02C 23/36; B02C 18/00

[52] U.S. Cl. ..... 241/30; 241/58; 241/251; 241/275; 241/299

[58] Field of Search ..... 241/30, 33, 34, 36, 241/58, 171, 172, 222, 251, 253, 257, 275, 299, 85

[56] References Cited

U.S. PATENT DOCUMENTS

| | | | |
|---|---|---|---|
| 1,034,235 | 7/1912 | Hermans . | |
| 2,974,701 | 3/1961 | Eberman . | |
| 3,223,336 | 12/1965 | Wienert | 241/172 |
| 3,228,442 | 1/1966 | Borsuk et al. . | |
| 4,274,360 | 6/1981 | Hofmann et al. | 241/DIG. 10 X |

FOREIGN PATENT DOCUMENTS

| | | | |
|---|---|---|---|
| 159711 | 4/1905 | Fed. Rep. of Germany . | |
| 929336 | 7/1955 | Fed. Rep. of Germany . | |
| 1122822 | 5/1962 | Fed. Rep. of Germany | 241/82 |
| 46-1181 | 2/1971 | Japan | 241/58 |

*Primary Examiner*—Howard N. Goldberg
*Assistant Examiner*—Timothy V. Eley
*Attorney, Agent, or Firm*—Charles Hieken

[57] ABSTRACT

A process for cutting of material includes the continuous loading therefrom into a generally cylindrically or conically shaped vessel, which is rotating around its longitudinal axis, in which is mounted a fast rotating knife shaft, its knives which are provided with one or several cutting edges reach near to the inside wall of the vessel. The material to be cut, loaded into the vessel in axial direction, deposits a layer on the inside wall of the vessel in consequence of the centrifugal force, which is treated by the knives and is displaced in axial direction to the discharging end of the vessel where the cut material is continuously taken away. The equipment includes a material feeding device, a drive for the vessel and the knife shaft, each with different speed, as well as a discharging device for the cut material. The axis of the rotating vessel as well as of the knife shaft can be vertically or horizontally arranged.

25 Claims, 8 Drawing Figures

PROCESS AND EQUIPMENT FOR CONTINUOUS CUTTING OF MATERIAL

Figure 1:
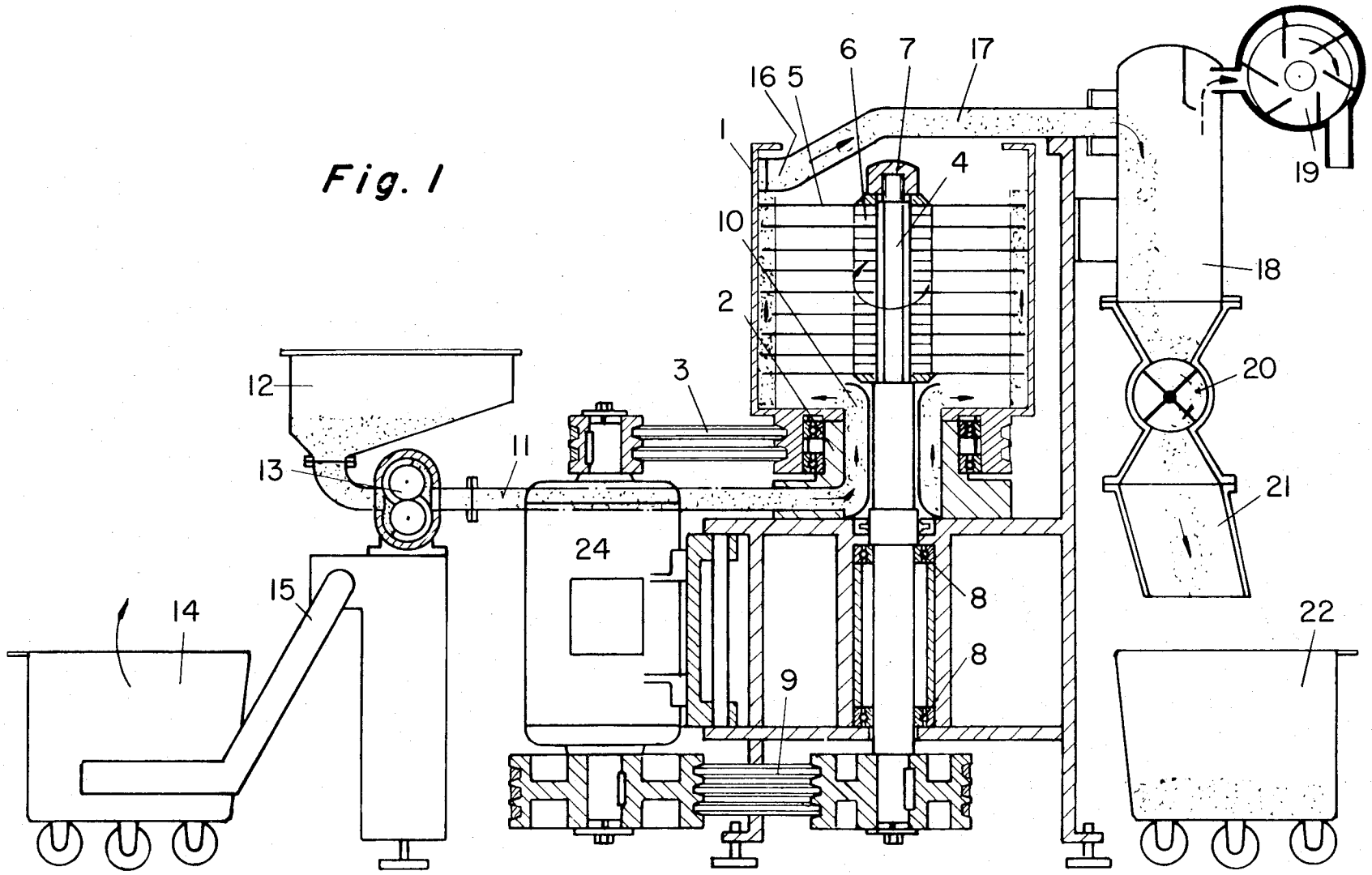

The invention concerns a process for cutting of material, whereas the material is treated with fast rotating knives, as well as an equipment for carrying out this process.

For such working processes, especially in the range of the meat processing industry, so-called Cutters have been mostly employed up to now, with good results. A special advantage of the Cutter is that the material is so processed by the drawing cut of the Cutter knives or blades, that a fine cutting results whereby an excellent binding between water, fat and protein can be obtained.

Of course there are cogently some aggravating disadvantages in connection with the well known Cutters. The cutting operation requires a discontinuous method of working. There are considerable non-productive times of charging and discharging, that are very costly for such an expensive machine. By raising capacity, the required costs are increased at the same time, whereas on the other side also a very high demand of capacity heretofore exists.

Mills have been already used too for cutting, which of course make possible a continuous method of operation, but by far no comparable quality of the cut material is obtained because of local over-heatings in consequence of high mechanical friction.

It is an important object of the invention to provide improved cutting apparatus and techniques that avoid the disadvantages mentioned above while maintaining the quality of the cut material in a continuous cutting process.

This problem is solved according to the invention by the mentioned characteristics of the main claim. Regarding further important characteristics of invention of the process, as also the equipment for carrying out this process, it is referred to the dependent claims.

According to the invention, the cut material is continuously transported into a generally cylindrically or conically shaped vessel, which is rotating around its longitudinal axis and which is provided with a shaft equipped with knives or blades which is substantially arranged parallel to the vessel axis, whereas the vessel will be turned with such a speed that the fed material is guided to the inside of the vessel wall by the centrifugal force, whilst the cut material is drawn off continuously. A continuous method of operation of the equipment is made possible hereby, at which the drawing cut of the cutter knives is maintened for obtaining the same high quality of material. The material to be cut is continuously transported into the rotating vessel at which a predetermined thickness of layer is built up by the centrifugal force, on the inside of the vessel wall. This layer of material is treated by the fast rotating knives with drawing cut. The material to be treated is preferably fed on one side or end of the vessel in axial direction, whereas the cut material is drawn off on the opposite side or end of the vessel. Consequently a continuous method of operation is obtained, so that compared with usual batch cutter arrangements, at a considerable lower capacity of vessel, an increased output per day is realized with the invention.

According to the favoured kind of execution of the process as per the invention, the cutting process is carried out under vacuum, so that the material is cut and mixed without air. Missing of air in the processed material prolongs the shelf life of the material, especially when it concerns perishable food, as e.g. meat.

But on the other side a vacuum operation is not absolutely necessary according to the invention, because an internal pressure is built up in the layer of material on the inside wall of the vessel in consequence of the centrifugal force, which excludes air.

The grade of fineness of the cut material can be controlled in different ways, according to the invention. The feeding speed of material and the rotary speed of the knives in proportion to the rotary speed of the vessel. Besides, the grade of fineness of the cut material can be controlled by the absolute rotary speed of the vessel, as at increased rotary speed of the vessel, the material is "kept" on the inside wall of the vessel in consequence of the increased centrifugal force, so that a better cutting is possible.

According to the invention, the equipment for carrying out the process may comprise a vessel rotating around its longitudinal axis, provided with an axial feeding channel for the material, in which a knife-carrying driven shaft parallel to the vessel axis is installed. According to a favoured kind of execution, for the drive of the vessel as well as also for the knife shaft, there is one motor. It can be a driving motor with two shaft ends, or a transmission gear for driving the vessel and the knife shaft can be provided.

Specially favoured is turning the vessel and the knife shaft with different speed in the same direction. The direction of rotation of the vessel and the knife shaft can be opposite. Attention must be paid here that the relative speed between vessel and running knives will not be too high, because the vessel must be driven with a predetermined minimum rotary speed, to keep the material on the inside wall of the vessel.

A continuous working, controllable material feeding device is usefully premounted to the feeding channel, at which it may comprise a pump for thick material. The material to be cut can be steadily fed into the vessel, controlling the feeding speed to control the grade of fineness of the material.

At the vessel on the opposite side of the feeding channel is mounted a peeling head for discharging the material from the vessel. This peeling head makes possible a continuous and uniform loosening of the layer of material from the inside wall of the vessel. According to one kind of execution of the invention, the longitudinal axis of the vessel and of the knife shaft is vertically arranged. Especially favoured at this kind of execution, a material discharging tube is mounted to the peeling head which practically is connected to the vacuum tank. An even discharging of the cut material is aided hereby.

According to another kind of execution of the invention, the longitudinal axis of the vessel is horizontally arranged. In most cases of this kind of execution, mounting of a discharging chute to the peeling head is sufficient.

According to the invention, several knives with one or several cutting edges are arranged on the knife shaft, whereas the angles on the knife edge of axial adjacent cutting edges each is alternately arranged that is to say, the knives or blades are formed with axially adjacent blades having oppositely beveled cutting edges. The angle on the knife edge operates as conveyor for the material in the interior of the vessel. An unwished strong transport of the material is avoided or at least limited by the execution according to the invention.

According to a favoured kind of execution, the vessel and the knife shaft are coaxially arranged. An advantage is that the knife edges reach into the material to be cut over the whole extent on the inside of the vessel. The efficiency is considerably increased accordingly, compared with the usual Cutters.

But on the other side, according to another kind of execution, the axis of vessel and knife shaft can be relatively staggered, whereas for feeding of material a loading tube is mounted in the region between the blade edges and inside wall of the vessel. The advantage of this kind of execution is that feeding and discharging of material can be performed from one side of the vessel.

If processing under vacuum is desired, it can be useful to connect the vessel to an evacuating device, at which it is advantageous to manufacture the knife shaft in form of a hollow shaft in order to produce the vacuum in the inside of the vessel.

Figure 2:
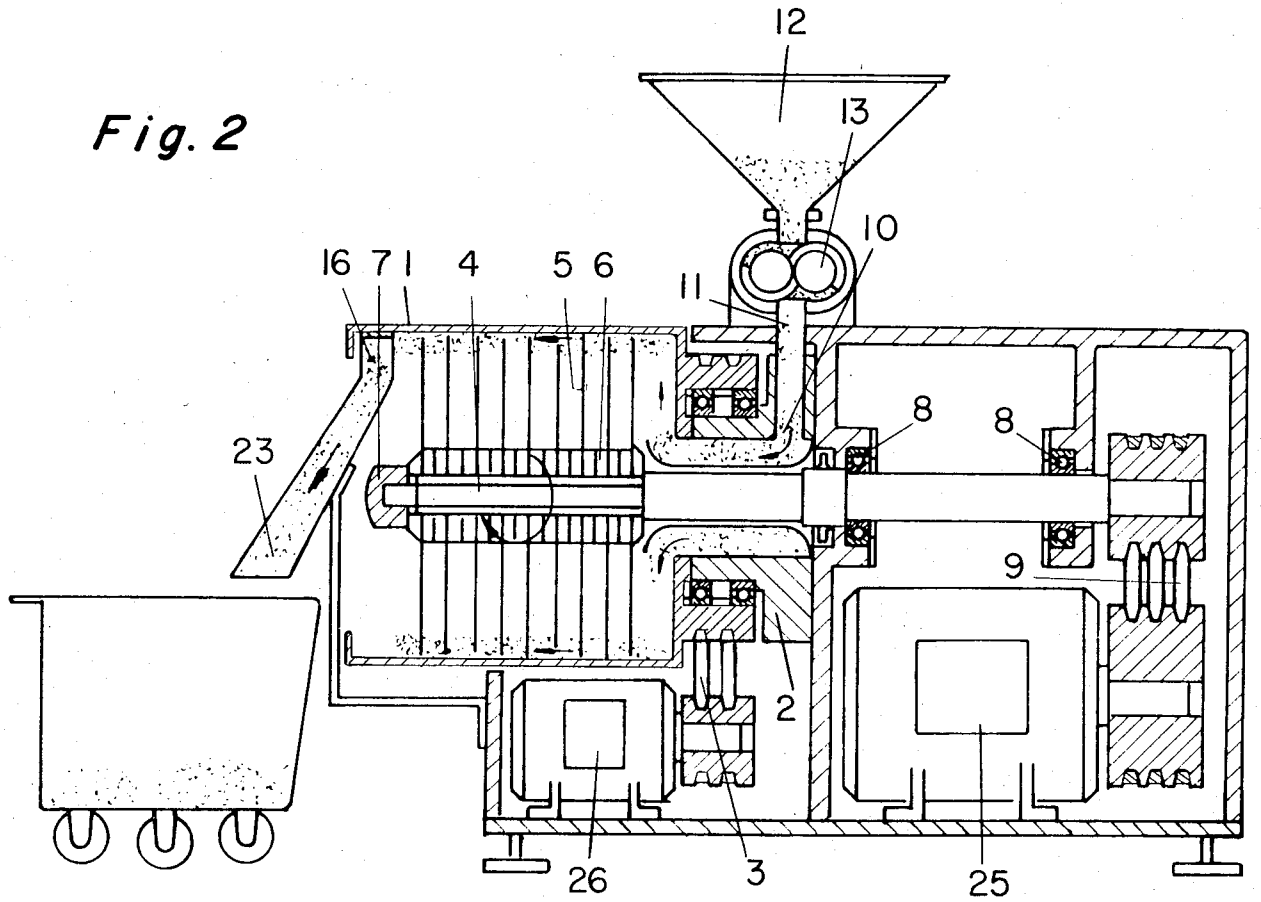
Figure 3:
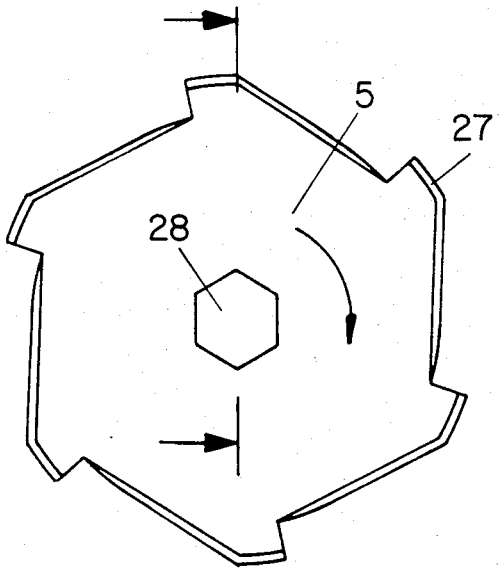
Figure 4:
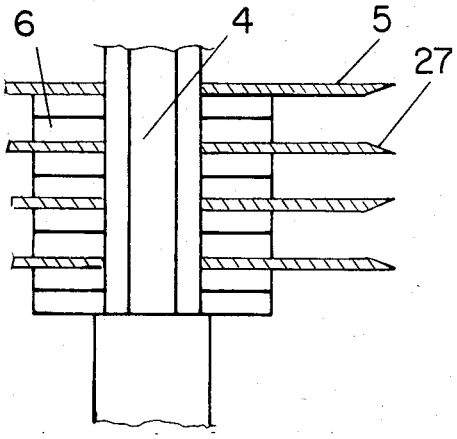
Figure 5:
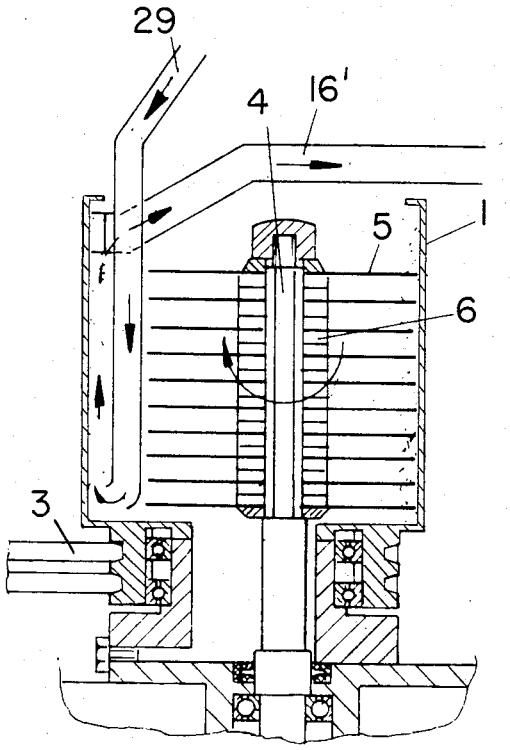
Figure 6:
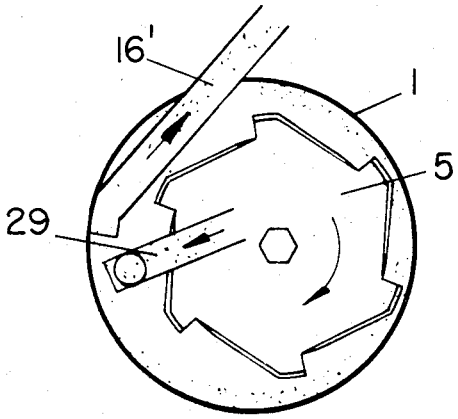
Figure 7:
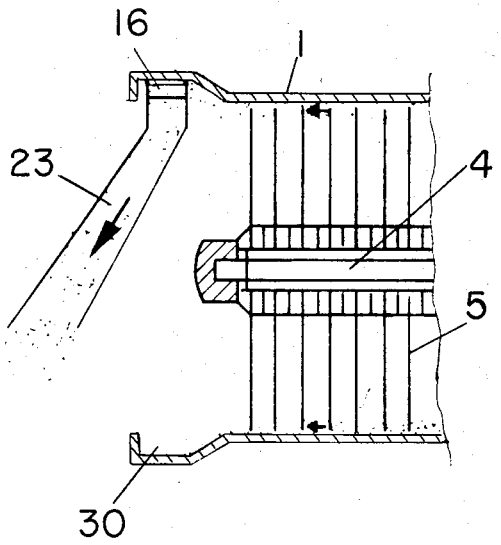
Figure 8:
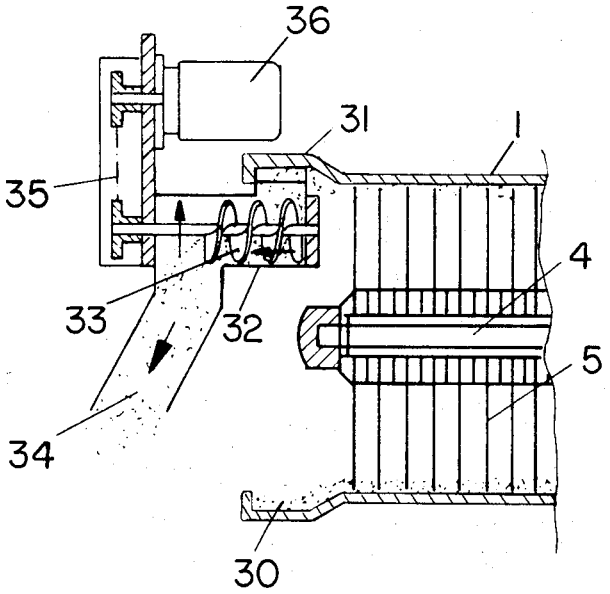

Further advantages, details and important characteristics of the invention will be better understood from the following description of different examples regarding execution of the invention with regard to the attached drawings. In particular shown as follows:

FIG. 1 is a side view of the invented equipment in diagrammatic representation, partially in section, FIG. 2 is a presentation corresponding to FIG. 1 but of another kind of execution of the invention, FIG. 3 is the top view of one knife with several cutting edges that is arranged on the knife shaft, FIG. 4 is a longitudinal section through a part of the several knives carrying knife shaft, FIG. 5 is a longitudinal section through the arrangement of the vessel and the knife shaft of another kind of execution of the invention, FIG. 6 is a cross section through the arrangement according to FIG. 5 is, FIG. 7 is a portion of FIG. 2, but with another kind of execution of the vessel and with discharging chute 23, FIG. 8 is a presentation corresponding to FIG. 7, but with another kind of execution of the discharging device.

First of all, a kind of execution of the invented equipment with reference to FIG. 1 shall be explained as follows.

A generally cylindrically shaped vessel 1 is rotatably mounted on a machine frame by a bearing 2. The vessel can also be shaped conically. The drive is effected by a driving motor 24 via a V-belt drive 3.

At this kind of execution the rotary axis of the vessel 1 is vertically arranged. Coaxial to the axis of the vessel there is a knife shaft 4 rotatably mounted in a bearing 8, opposite to the machine frame. The drive of the knife shaft 4 is effected by the driving motor 24 provided with two shaft ends, via a further V-belt drive 9.

Coaxial to the knife shaft 4 in the area of the inlet opening of the vessel 1 there is mounted a feeding channel 10 for the material to be cut, which is generally shaped like a hollow cylinder. A feeding tube 11 which is connected to a pump for thick material 13 runs into this feeding channel 10. Ahead of a filling hopper 12, a pump for thick material 13 is installed.

On the knife shaft 4 that is polygonally shaped in cross section in the area of the vessel, knives 5 are mounted which can be provided with several cutting edges, as this is shown in FIG. 3. For a good efficiency of the knives 5, these are provided with a polygonal accepting bore 28 in the center. Between adjacent knives 5, there are intermediate disks 6, according to the presentation in FIG. 4. The knives are kept on the knife shaft 4 by a tension nut 7.

FIG. 4 shows further that the angles on the knife edge 27 of axial adjacent cutting edges of the knives 5 are alternately aligned. That is to say, the knives or blades 5 are formed with axially adjacent blades having oppositely beveled cutting edges 27. Hereby is obtained a compensation of the transport efficiency by the angles on the knife edge 27 of the knives 5, at high rotary speed. The diameter of the knives 5 is only a little smaller than the inside diameter of the vessel 1.

At the discharging end of the vessel 1, a peeling head 16 reaches into the vessel 1 up to close to the inside of the terminal wall.

A discharging tube 17 is attached to the peeling head 16. In order to bring out easily upwards the cut material from the unit, the discharging tube 17 reaches into a vacuum tank 18. For producing vacuum in the tank 18, a vacuum pump 19 is installed. For discharging the material from the vacuum tank 18 there is a bucket wheel sluice 20, to which a discharging tube 21 is attached to.

The method of operation of the described kind of execution is as follows: The material to be cut is transported by a trolley 14 up to the charging end of the equipment. The material is tilted into the hopper 12 by means of a lifting and tilting device 15. The uniform feeding of material to be cut into the vessel 1 is carried out by the pump for thick material 13, the feeding tube 11, as well as the feeding channel 10.

Because of the rotation of the vessel 1 around its longitudinal axis, a layer of the material of uniform thickness is built up on the inside of the wall of the vessel 1. The thickness of the layer depends, among other factors, on the feeding speed by the pump for thick material 13. The knives 5 rotating with a considerably higher speed in the same direction of rotation, divide the layer of material on the inside of the vessel 1 by a drawing cut.

In consequence of the rotation of the vessel and thereby the centrifugal force acting on the material to be cut on the one side, and the feeding of material by means of the pump for thick material 13 on the other side, the material is transported along the inside wall of the vessel 1 in axial direction to the discharging end. At the discharging end of the vessel 1, the peeling head 16 comes from the open end of the vessel 1 near to the inside wall of the vessel to loosen the material. Because of the vacuum produced in the tank 18 by the vacuum pump 19, the material is drawn off from the vessel 1 through the discharging tube 17. The cut material accumulating on the bottom of the tank 18 is set free by maintaining the vacuum inside of the tank 18 by means of a bucket wheel sluice 20 and fed through the discharging tube 21 to a trolley 22 for carrying away.

FIG. 2 shows another kind of execution of the invented equipment. It differs in general from the described kind of execution in connection with pict. 1 by the horizontal arrangement of the axis of vessel 1 as well as of the knife shaft 4. Here is also installed a hopper 12 to which a pump for thick material 13 is attached, with which the material to be cut is fed through a feeding tube 11 and a feeding channel 10 in form of a hollow cylinder, into the vessel 1.

As FIG. 2 shows, the vessel 1 which is kept in the frame by a bearing 2, is driven by an electric motor 26 with V-belt drive 3, whereas the knife shaft 4 which is also horizontally kept in the frame by a bearing 8, is driven by a special driving motor 25 and the belt drive 9. But also with this kind of execution, the drive of vessel 1 as well as of the knife shaft 4 could be carried out by means of one motor only, perhaps with two shaft ends or with transmission gear. Operation of the knife shaft 4 with the knives 5 is the same as it has been described in connection with the kind of execution according to FIG. 4 with reference to FIGS. 3 and 4.

At the discharging end of the vessel 1 comes a peeling head 16 at its inside wall to loosen the material which is transported by a discharging chute 23 to the trolley for carrying away the cut material.

The method of operation of the last described kind of execution is in general the same as for the first one. The material to be treated is fed into the vessel 1 by the hopper 12, the pump for thick material 13, the feeding tube 11 and the feeding channel 10. As indicated in the drawing by dotting, a layer of material is built up on the inside wall of the vessel, which is transported along the wall in axial direction to the discharging end. During this movement, the material is treated and cut by the knives 5 that reach nearly until the wall of the vessel 1. The grade of fineness of material can also be controlled here by the loading speed, the relative speed between vessel 1 and knives 5 and/or the absolute rotary speed of the vessel 1.

This kind of execution does not need vacuum as the treated material loosened by the peeling head 16, falls into the trolley in consequence of its gravity via the discharging chute 23.

Another kind of execution of the equipment is schematically shown in FIGS. 5 and 6. The knife shaft 4 is here parallel, but staggered relative to the axis of vessel 1. A free region results on one side beside the knives 5 kept on the knife shaft 4, through which a feeding tube 29 is guided up to the inlet end of vessel 1. The advantage of this kind of execution is that loading and unloading of material is possible from one side of the vessel 1. Also at this kind of execution, a peeling head 16 for loosening of material is mounted on the discharging end of vessel 1. The discharging of material, at vertical arrangement of knife shaft 4 and axis of rotation of the vessel 1 is effected by a discharging tube 16' which is mounted to a vacuum system. But at horizontal alignment of the axis, as at the second described kind of execution, it can be performed by a discharging chute.

Other kinds of execution are shown in FIGS. 7 and 8. Vessel 1 and knife shaft 4 are here arranged as at the kind of execution according to FIG. 2. But the vessel 1 has a ring-cylindrically shaped enlargement 30 on the discharging side of enlarged cross section from which the cut material is discharged. That is effected, at kind of execution according to FIG. 7, by means of peeling head 16 and the discharging chute 23.

At the kind of execution according to FIG. 8, the discharging is effected by a peeling head 31 from the ring-cylindrically shaped enlargement 30 of the vessel 1, which is mounted in a worm box 32. The conveyor worm 33 mounted there, transports the cut material via a discharging chute 34. The drive of this equipment is effected by means of V-belt- or chain drive 35 and electric motor 36.

There has been described novel apparatus and techniques especially useful for meat processing. The invention is also useful in numerous other applications, such as in cheese manufacture and in the pharmaceutical industry. It is evident that those skilled in the art may now make numerous other uses and modifications of and departures from the specific embodiments described herein without departing from the inventive concepts. Consequently, the invention is to be construed as embracing each and every novel feature and novel combination of features present in or possessed by the apparatus and techniques herein disclosed and limited solely by the spirit and scope of the appended claims.

What is claimed is:

1. Process for cutting material with fast rotating blades on a shaft parallel to the axis of a vessel including the steps of, continuously feeding material into said vessel while rotating said vessel around said axis with sufficient speed so that the fed material is guided to and positioned against the inside of the vessel wall by the centrifugal force and cut by said fast rotating blades while positioned against the inside of the vessel wall, and continuously withdrawing the cut material from said vessel thus rotating.

2. Process according to claim 1 and further including the steps of feeding material to be cut at one end of the vessel in axial direction, and withdrawing the cut material from the opposite end of the vessel.

3. Process according to claims 1 or 2 and further including the step of, establishing a vacuum in said vessel.

4. Process according to claims 1 or 2 and further including the step of, controlling the rate at which material enters said vessel to control the fineness of the cut material leaving said vessel.

5. Process according to one of claims 1 or 2 and further including the step of, controlling the rotary speed of the blades to control the fineness of the cut material leaving said vessel.

6. Process according to one of claims 1 or 2 and further including the step of, controlling the rotary speed of the vessel to control the fineness of the cut material leaving said vessel.

7. Equipment comprising a vessel rotatable about its axis, blades and a shaft, said equipment for carrying out a process for cutting material with fast rotating blades on said shaft parallel to said axis of said vessel including the septs of continuously feeding material into said vessel while rotating said vessel around said axis with sufficient speed so that the fed material is guided to and positioned against the inside of the vessel wall by centrifugal force and there cut by said fast rotating blades while positioned against the inside of the vessel wall, and continuously withdrawing the cut material from said vessel thus rotating and said equipment further comprising, means for rotating said vessel around said axis with sufficient speed to position said material against the inside of the vessel wall by centrifugal force, means for continuously feeding said material into said vessel while said vessel is thus rotating, said shaft being parallel to said axis and carrying said blades adjacent to the inside of the vessel wall, means for rotating said shaft to cause said blades to cut said material while said vessel is thus rotating with said material positioned against the inside of the vessel wall, and means for continuously withdrawing the cut material from said vessel while said vessel is thus rotating.

8. Equipment according to claim 7 and further comprising, a motor comprising said means for rotating the vessel and said means for rotating said shaft.

9. Equipment according to claim 7 and further comprising means for rotating said vessel and shaft with different speeds.

10. Equipment according to claim 7 and further comprising means for rotating the vessel and the shaft in opposite directions.

11. Equipment according to claim 7 wherein said means for feeding comprises, means for continuously feeding said material into said vessel at a controllable rate.

12. Equipment according to claim 11 wherein said means for feeding comprises a pump for thick material.

13. Equipment according to claim 7 and further comprising, means for withdrawing the cut material from said vessel including a peeling head.

14. Equipment according to claim 13 wherein said means for withdrawing further comprises a material discharging tube adjacent to the peeling head.

15. Equipment according to claim 14 wherein said means for withdrawing further comprises a vacuum tank connected to said material discharging tube.

16. Equipment according to claim 7 wherein said shaft and said axis are vertical.

17. Equipment according to claim 7 wherein said shaft and said axis are horizontal.

18. Equipment according to claim 17 and further comprising means for withdrawing the cut material from said vessel including a discharging chute connected to a peeling head.

19. Equipment according to claim 7 wherein said blades are formed with axially adjacent blades having oppositely beveled cutting edges.

20. Equipment according to claim 7 wherein said shaft is radially displaced from said axis, and said means for feeding material comprises a loading tube located in the region between said blades and an inside wall of said vessel.

21. Equipment according to claim 7 and further comprising means for evacuating said vessel.

22. Equipment according to claim 21 wherein said shaft is hollow and comprises said means for evacuating.

23. Equipment according to claim 7 wherein said vessel is of enlarged cross section at the end thereof where cut material is withdrawn.

24. Equipment according to claim 23 and further comprising means for withdrawing the cut material including a peeling head extending into said enlarged cross section.

25. Equipment according to claim 24 and further comprising, a worm casing with a conveyor worm connected to said peeling head, an electric motor, and means for coupling said electric motor to said conveyor worm for driving said worm.

* * * * *